US011054142B2

(12) United States Patent
Xu

(10) Patent No.: US 11,054,142 B2
(45) Date of Patent: Jul. 6, 2021

(54) LIQUID-COOLED INTELLIGENT ALCOHOL FIREPLACE

(71) Applicant: Wang Xu, Taishan (CN)

(72) Inventor: Wang Xu, Taishan (CN)

( * ) Notice: Subject to any disclaimer, the term of this patent is extended or adjusted under 35 U.S.C. 154(b) by 179 days.

(21) Appl. No.: 16/542,487

(22) Filed: Aug. 16, 2019

(65) Prior Publication Data

US 2021/0048197 A1 Feb. 18, 2021

(51) Int. Cl.

| | |
|---|---|
| ***F24C 5/18*** | (2006.01) |
| ***F24C 5/16*** | (2006.01) |
| ***F24C 5/14*** | (2006.01) |
| *F24C 5/00* | (2006.01) |

(52) U.S. Cl.

CPC ..... *F24C 5/18* (2013.01); *F24C 5/14* (2013.01); *F24C 5/16* (2013.01); *F24C 5/00* (2013.01)

(58) Field of Classification Search

CPC ..... F24C 5/18; F24C 5/14; F24C 5/16; F24C 5/00

See application file for complete search history.

(56) References Cited

U.S. PATENT DOCUMENTS 8,915,732 B1 * 12/2014 Bebon ..... F24C 5/16 431/152
9,074,763 B2 * 7/2015 Begg ..... F23D 5/14
9,353,942 B2 * 5/2016 Stellema ..... F23D 3/18
9,518,732 B2 * 12/2016 Deng ..... F23D 17/002
9,562,693 B2 * 2/2017 Husted ..... F24C 5/12
2014/0158111 A1 * 6/2014 Zhou ..... F23D 14/28 126/512

FOREIGN PATENT DOCUMENTS

CN 2048830063 U * 1/2015 ..... F24C 5/14
CN 205746988 U * 11/2016 ..... F24B 1/183
CN 208566761 U * 3/2019 ..... F24C 15/14
CN 212132542 U * 12/2020 ..... F24C 5/10

* cited by examiner

*Primary Examiner* — David J Laux
*Assistant Examiner* — Nikhil P Mashruwala
(74) *Attorney, Agent, or Firm* — W&K IP

(57) ABSTRACT

The present disclosure provides a liquid-cooled intelligent alcohol fireplace. The liquid-cooled intelligent alcohol fireplace comprises a fireplace body consisting of a shell, an alcohol storage box, a combustion groove and a faceplate, an alcohol supplying assembly, a liquid cooling assembly and a circuit assembly; the alcohol supplying assembly comprises an alcohol container, alcohol supply pipes, an alcohol inlet, an alcohol self-priming pump, a submersible pump and an alcohol discharge head; the liquid cooling assembly comprises a first cooling pipe, a second cooling pipe, a first cooling self-priming pump, a second cooling self-priming pump, cooling liquid flowing pipes and a cooling liquid container; and the circuit assembly comprises a start switch, an ignition switch, a main control board, an ignition needle, a temperature sensor, a first liquid level sensor, a second liquid level sensor and a third liquid level sensor.

6 Claims, 6 Drawing Sheets

LIQUID-COOLED INTELLIGENT ALCOHOL FIREPLACE

TECHNICAL FIELD

The present disclosure relates to fireplaces, and specifically relates to a liquid-cooled intelligent alcohol fireplace.

BACKGROUND

A fireplace is originated in western countries and has practicability and ornamental feature. With the continuous improvement of living standards and life taste of people, the fireplace is gradually applied to the domestic home decoration. The traditional fireplace takes woods as fuel, and recently is gradually replaced by a cleaner and more environmentally friendly alcohol fireplace using alcohol as the fuel. A common alcohol fireplace only is a device formed by simply welding metal materials, ignition and alcohol addition are operated manually so as to be inconvenient and unsafe, and the temperature of a fireplace body and the size of flame are hard to be controlled in the alcohol combusting process, so the alcohol fuel is easy to be wasted.

SUMMARY

An objective of the present disclosure is to provide a liquid-cooled intelligent alcohol fireplace, which has relatively high automatization degree and relatively great safety in use and can effectively control the temperature of the fireplace and the size of flame, by aiming at problems in the prior art.

A technical scheme of the present disclosure is: the liquid-cooled intelligent alcohol fireplace comprises a fireplace body, the fireplace body comprises a shell, an alcohol storage box, a combustion groove and a faceplate; and its structure is characterized by further comprising an alcohol supplying assembly, a liquid cooling assembly and a circuit assembly;

the alcohol supplying assembly comprises an alcohol container, alcohol supply pipes, an alcohol inlet, an alcohol self-priming pump, a submersible pump and an alcohol discharge head; the alcohol container and the fireplace body are separately arranged; the alcohol inlet is fixedly formed in the faceplate, and the alcohol self-priming pump and the submersible pump are fixedly mounted in the shell; the alcohol discharge head is fixedly arranged on the combustion groove; therefore, the alcohol container, the alcohol inlet, the alcohol self-priming pump, the alcohol storage box, the submersible pump, the alcohol discharge head and the alcohol supply pipe for connecting form alcohol conveying channels;

the liquid cooling assembly comprises a first cooling pipe, a second cooling pipe, a first cooling self-priming pump, a second cooling self-priming pump, cooling liquid flowing pipes and a cooling liquid container; the first cooling pipe and the second cooling pipe are fixedly arranged in the lower portion of the combustion groove; the first cooling pipe, the first cooling self-priming pump, the cooling liquid container and the cooling liquid flowing pipes for connecting form a first liquid cooling channel; the second cooling pipe, the second cooling self-priming pump, the liquid container and the cooling liquid flowing pipes for connecting form a second liquid cooling channel; and the circuit assembly comprises a start switch, an ignition switch, a main control board, an ignition needle, a temperature sensor, a first liquid level sensor, a second liquid level sensor and a third liquid level sensor; the start switch and the ignition switch are fixedly arranged on the faceplate; the main control board is fixedly arranged in the shell; the ignition needle is fixedly arranged on the combustion groove and is located by the side of the alcohol discharge head; and the temperature sensor, the first liquid level sensor, the second liquid level sensor and the third liquid level sensor are fixedly arranged on the combustion groove; and the start switch, the ignition switch, the ignition needle, the temperature sensor, the first liquid level sensor, the second liquid level sensor, the third liquid level sensor, the alcohol self-priming pump, the submersible pump, the first cooling self-priming pump and the second cooling self-priming pump are electrically connected with the main control board.

A further scheme is: the circuit assembly further comprises a loudspeaker electrically connected with the main control board.

A further scheme is: a thermal insulator is arranged between the faceplate of the fireplace body and the combustion groove.

A further scheme is: the thermal insulator arranged between the faceplate of the fireplace body and the combustion groove is made of bakelite.

A further scheme is: heat dissipation holes are formed in the shell.

A further scheme is: the material of the combustion groove is aluminum alloy.

The present disclosure has the positive effects: (1) the liquid-cooled intelligent alcohol fireplace of the present disclosure can automatically add alcohol, automatically control the liquid level of the alcohol in the combustion groove and automatically control the temperature of the combustion groove in use by utilizing a structure design, in which the alcohol supplying assembly, the liquid cooling assembly and the circuit assembly match with the fireplace body, so as to correspondingly control the size of alcohol flame, which is convenient and safe in use, saves energy and protects the environment; and (2) the liquid-cooled intelligent alcohol fireplace of the present disclosure can largely reduce the temperature of the faceplate in use to prevent the faceplate from turning black, deforming and aging by arranging the thermal insulator between the faceplate of the fireplace body and the combustion groove, so as to prolong the service life.

Figure 1:
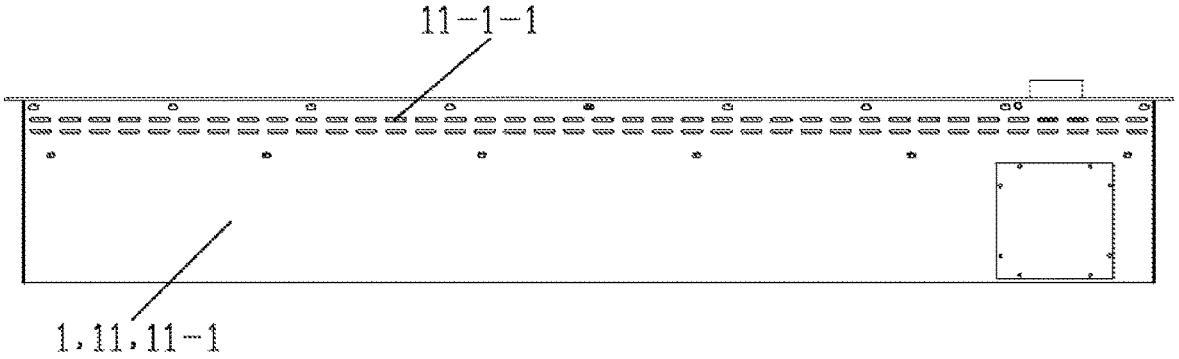
FIG. 1 is a schematic structural diagram of a fireplace body in the present disclosure.

Reference signs in the drawings are as follows:

1, fireplace body; 11, shell; 11-1, shell body; 11-2-end cover plate; 11-1-1, heat dissipation hole; 12, alcohol storage box; 13, combustion groove; 14, faceplate; and 15, thermal insulator;

2, alcohol supplying assembly; 21, alcohol container; 22, alcohol supply pipe; 23, alcohol inlet; 24, alcohol self-priming pump; 25, submersible pump; and 26, alcohol discharge head;

3, liquid cooling assembly; 31, first cooling pipe; 32, second cooling pipe; 33 first cooling self-priming pump; 34, second cooling self-priming pump; 35, cooling liquid flowing pipe; and 36, cooling liquid container; and 4, circuit assembly; 41, start switch; 42, ignition switch; 43, main control board; 44, ignition needle; 45, temperature sensor; 46, first liquid level sensor; 47, second liquid level sensor; and 48, third liquid level sensor.

DESCRIPTION OF THE EMBODIMENTS

The present disclosure will be further described in detail with reference to the accompanying drawings and specific embodiments.

Embodiment 1

Figure 2:
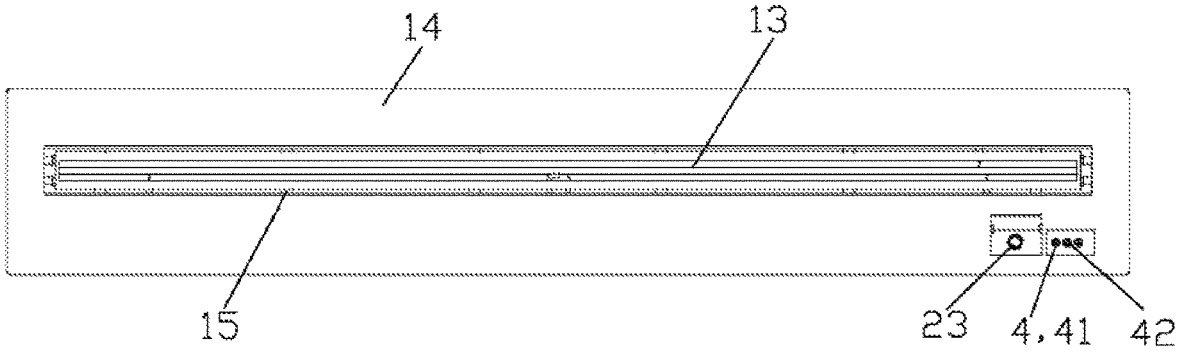
FIG. 2 is a top view of FIG. 1.
Figure 3:
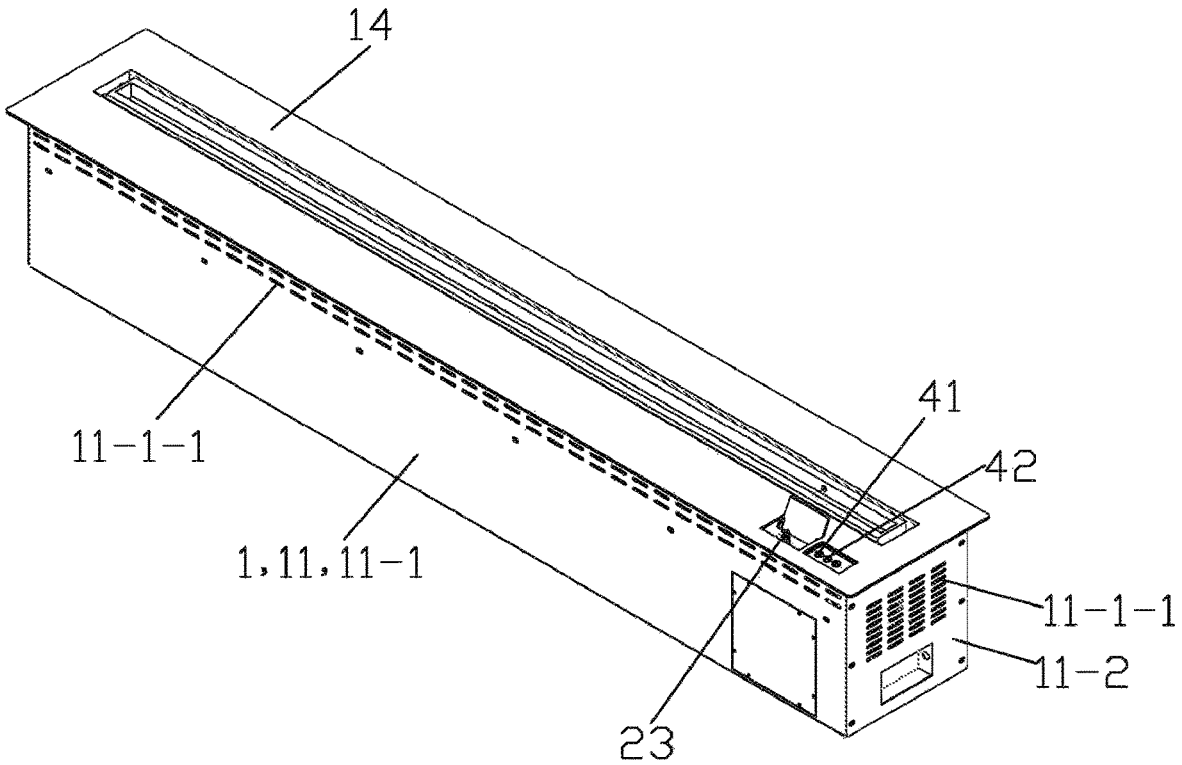
FIG. 3 is a schematic diagram of a stereo structure of the fireplace body in the present disclosure.
Figure 4:
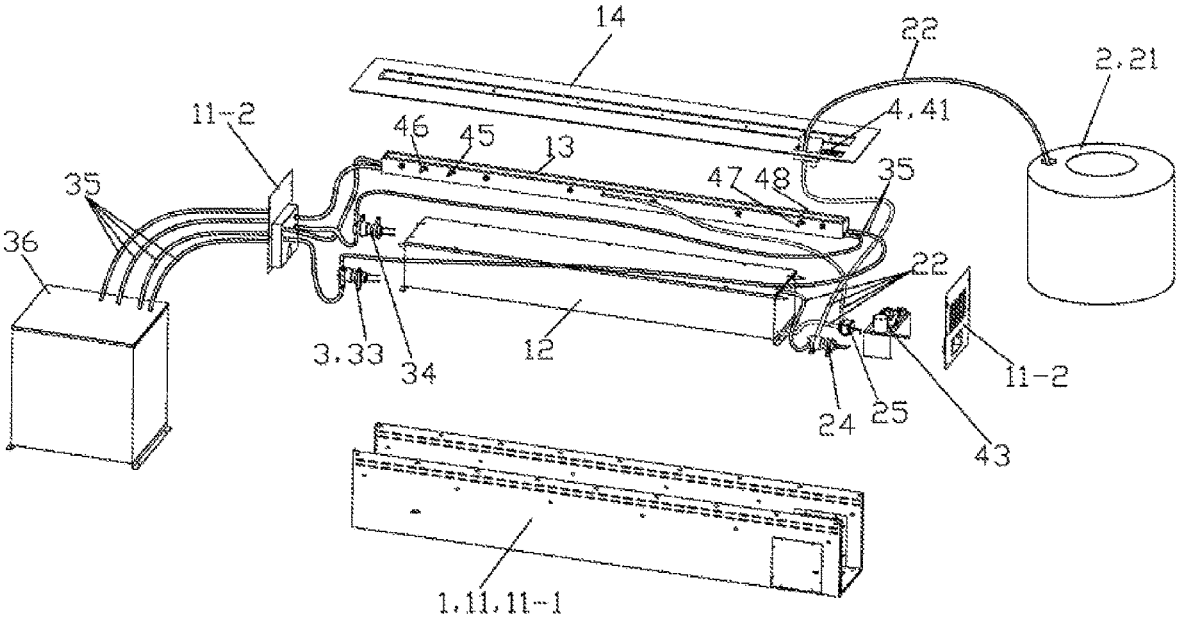
FIG. 4 is a schematic structural diagram of the present disclosure and shows the fireplace body by utilizing a split structure.
Figure 5:
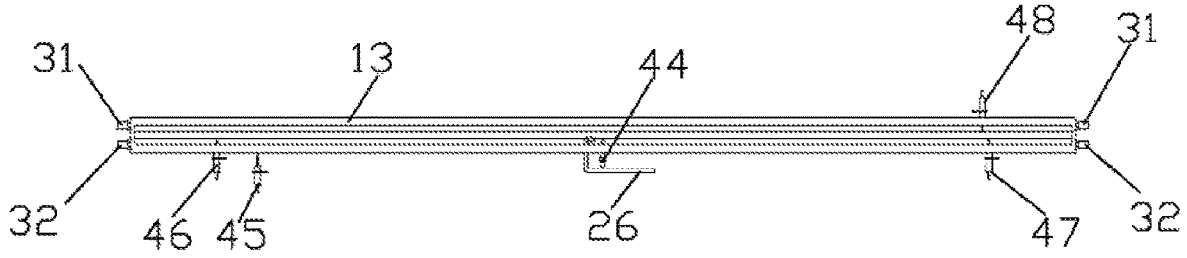
FIG. 5 is a schematic structural diagram of a combustion groove in FIG. 4 and also shows mounting relationships of the combustion groove and associated components.
Figure 6:
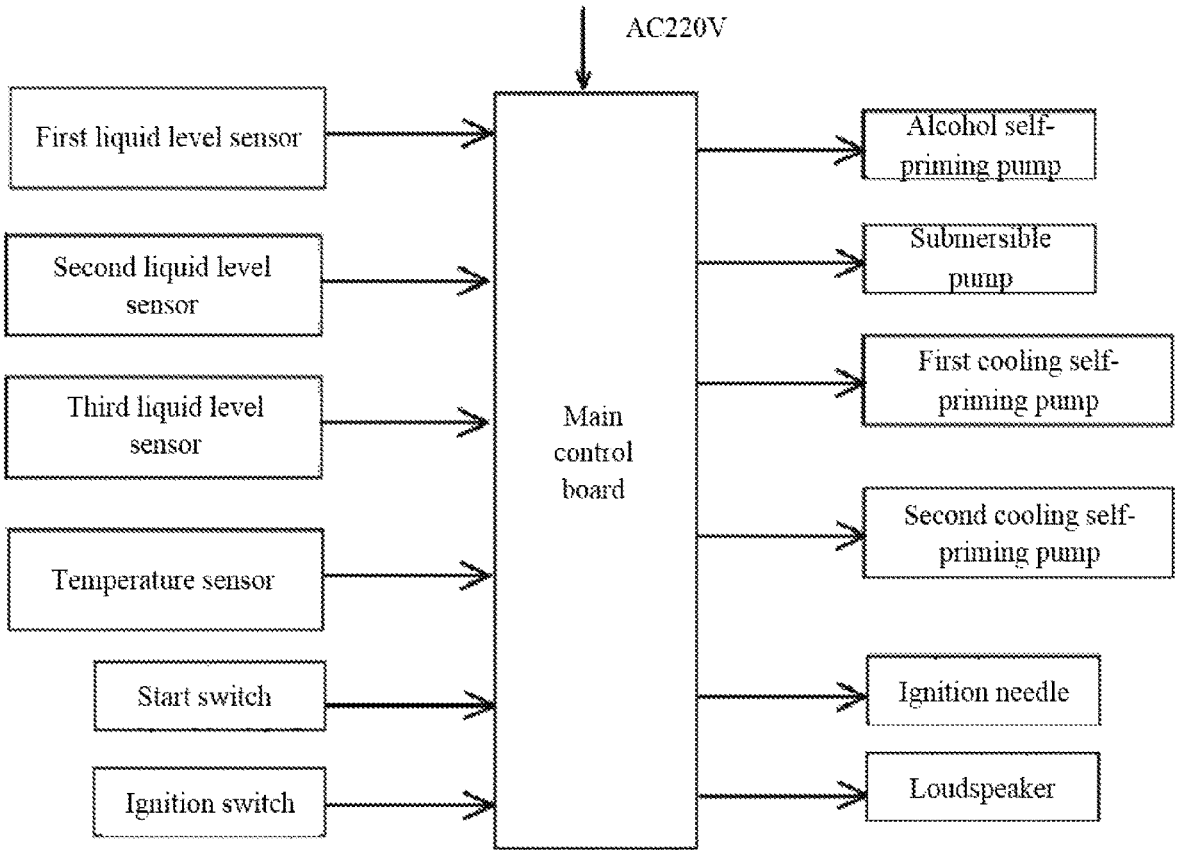
FIG. 6 is a schematic diagram of a circuit structure of the present disclosure.

As shown in FIG. 1 to FIG. 6, a liquid-cooled intelligent alcohol fireplace of the embodiment is mainly composed of a fireplace body 1, an alcohol supplying assembly 2, a liquid cooling assembly 3 and a circuit assembly 4.

The fireplace body 1 is mainly composed of a shell 11, an alcohol storage box 12, a combustion groove 13 and a faceplate 14; the shell 11 is mainly composed of a shell body 11-1 having U-shaped end faces and two end cover plates 11-2 arranged at the two ends of the shell body 11-1, and the shell 11 is provided with a plurality of heat dissipation holes 11-1-1; the alcohol storage box 12 is fixedly mounted in the shell body 11-1; the combustion groove 13 is fixedly mounted in the shell body 11-1 and is located above the alcohol storage box 12, wherein the material of the combustion groove 13 in the embodiment preferably utilizes aluminum alloy easy to dissipate heat; the faceplate 14 is fixedly mounted at the upper end of the shell 11; a thermal insulator 15 is arranged between the faceplate 14 and the combustion groove 13; and the material of the thermal insulator 15 in the embodiment preferably utilizes bakelite, the chemical name of the bakelite is phenolic plastic, and the bakelite has relatively higher mechanical strength, excellent insulativity, thermal resistance and corrosion resistance. The thermal insulator 15 is arranged between the faceplate 14 and the combustion groove 13 such that the temperature of the faceplate can be largely reduced in use.

The alcohol supplying assembly 2 is mainly composed of an alcohol container 21, alcohol supply pipes 22, an alcohol inlet 23, an alcohol self-priming pump 24, a submersible pump 25 and an alcohol discharge head 26.

The alcohol container 21 and the fireplace body 1 are separately arranged; the alcohol inlet 23 is fixedly formed in the faceplate 14 of the fireplace body 1, and the alcohol self-priming pump 24 and the submersible pump 25 are fixedly mounted in the shell 11; the alcohol discharge head 26 is fixedly arranged on the combustion groove 13 of the fireplace body 1; therefore, in use, the alcohol container 21, the alcohol inlet 23, the alcohol self-priming pump 24, the alcohol storage box 12, the submersible pump 25, the alcohol discharge head 26 and the alcohol supply pipes 22 for connecting all components form alcohol conveying channels.

The liquid cooling assembly 3 is mainly composed of a first cooling pipe 31, a second cooling pipe 32, a first cooling self-priming pump 33, a second cooling self-priming pump 34, cooling liquid flowing pipes 35 and a cooling liquid container 36.

The first cooling pipe 31 and the second cooling pipe 32 are fixedly arranged in the lower portion of the combustion groove 13; the first cooling pipe 31, the first cooling self-priming pump 33, the cooling liquid container 36 and the cooling liquid flowing pipes 35 for connecting all components form a first liquid cooling channel; the second cooling pipe 32, the second cooling self-priming pump 34, the liquid container 36 and the cooling liquid flowing pipes 35 for connecting all components form a second liquid cooling channel; in use, when the combustion groove 13 needs to cool down, liquid coolant flowing in the first cooling pipe 31 and the second cooling pipe 32 bring the heat away to achieve an objective of cooling.

The circuit assembly 4 is mainly composed of a start switch 41, an ignition switch 42, a main control board 43, an ignition needle 44, a temperature sensor 45, a first liquid level sensor 46, a second liquid level sensor 47, a third liquid level sensor 48 and a loudspeaker (which is not shown in the drawings).

The start switch 41 and the ignition switch 42 are fixedly arranged on the faceplate 14 of the fireplace body 1; the main control board 43 and the loudspeaker are fixedly arranged in the shell 11; the ignition needle 44 is fixedly arranged on the combustion groove 13 and is located by the side of the alcohol discharge head 26; and the temperature sensor 45, the first liquid level sensor 46, the second liquid level sensor 47 and the third liquid level sensor 48 are fixedly arranged on the combustion groove 13. In use, the temperature sensor 45 is used for detecting the temperature of the combustion groove 13 in real time; the first liquid level sensor 46 is used for detecting a high liquid level value of alcohol in the combustion groove 13 in real time; the second liquid level sensor 47 is used for detecting a low liquid level value of the alcohol in the combustion groove 13; and the third liquid level sensor 48 is used for preventing the alcohol in the combustion groove 13 from overflowing.

The start switch 41, the ignition switch 42, the ignition needle 44, the temperature sensor 45, the first liquid level sensor 46, the second liquid level sensor 47, the third liquid level sensor 48, the loudspeaker, the alcohol self-priming pump 24, the submersible pump 25, the first cooling self-priming pump 33 and the second cooling self-priming pump 34 are electrically connected with the main control board 43.

According to the liquid-cooled intelligent alcohol fireplace of the embodiment, the cooling liquid stored in the cooling liquid container 36 utilizes liquid which is suitable as a cooling medium, and prefers water in the embodiment.

The working principle and procedure of the liquid-cooled intelligent alcohol fireplace of the embodiment are briefly described as follows:

the liquid-cooled intelligent alcohol fireplace of the embodiment is externally connected to the mains supply AC220V, the circuit assembly 4 starts, the start switch 41 of the circuit assembly 4 is pressed down, the main control board 43 broadcasts fuel addition through the loudspeaker, the main control board 43 controls the alcohol self-priming pump 24 to start working, and the alcohol is pumped into the alcohol storage box 12 through the above alcohol conveying channel; at this time, the ignition switch 42 is switched on, the main control board 43 controls the submersible pump 25 to start working, the alcohol is automatically added into the combustion groove 13 through the above alcohol conveying channel, the main control board 43 controls the ignition needle 44 to ignite at the same time (and the ignition needle 44 is closed after ten seconds), the main control board 43 controls the submersible pump 25 to stop working when the liquid level of the added alcohol in the combustion groove 13 is detected by the first liquid level sensor 46 or the third liquid level sensor 48, and the main control board 43 controls the submersible pump 25 to start working again to add the alcohol when the liquid level of the added alcohol in the combustion groove 13 is detected by the second liquid level sensor 47 in use, repeating in this way.

In order to prevent the alcohol from boiling too much and prevent the flame from oversizing when the alcohol combusts in the combustion groove 13, the main control board 43 controls the first cooling self-priming pump 33 and the second cooling self-priming pump 34 to start working when the temperature sensor 45 detects the temperature of the combustion groove to reach a threshold, so as to use the liquid coolant flowing in the first cooling pipe 31 and the second cooling pipe 32 to bring the heat away to achieve the cooling, and to correspondingly achieve an objective of controlling the size of the alcohol combustion flame, which is safe and saves energy.

The above embodiment is intended to illustrate specific embodiments of the present disclosure, but not to limit the present disclosure. Those skilled in the related art can further make various modifications and variations without departing from the spirit and scope of the present disclosure to obtain corresponding equivalent technical schemes such that all those equivalent technical schemes should fall into the protection scope of the present disclosure.

What is claimed is:

1. A liquid-cooled intelligent alcohol fireplace, comprising a fireplace body (1), wherein the fireplace body (1) comprises a shell (11), an alcohol storage box (12), a combustion groove (13) and a faceplate (14); characterized by further comprising an alcohol supplying assembly (2), a liquid cooling assembly (3) and a circuit assembly (4); wherein the alcohol supplying assembly (2) comprises an alcohol container (21), alcohol supply pipes (22), an alcohol inlet (23), an alcohol self-priming pump (24), a submersible pump (25) and an alcohol discharge head (26); the alcohol container (21) and the fireplace body (1) are separately arranged; the alcohol inlet (23) is fixedly formed in the faceplate (14), and the alcohol self-priming pump (24) and the submersible pump (25) are fixedly mounted in the shell (11); the alcohol discharge head (26) is fixedly arranged on the combustion groove (13); therefore, the alcohol container (21), the alcohol inlet (23), the alcohol self-priming pump (24), the alcohol storage box (12), the submersible pump (25), the alcohol discharge head (26) and the alcohol supply pipes (22) for connecting from alcohol conveying channels;

the liquid cooling assembly (3) comprises a first cooling pipe (31), a second cooling pipe (32), a first cooling self-priming pump (33), a second cooling self-priming pump (34), cooling liquid flowing pipes (35) and a cooling liquid container (36); the first cooling pipe (31) and the second cooling pipe (32) are fixedly arranged in the lower portion of the combustion groove (13); the first cooling pipe (31), the first cooling self-priming pump (33), the cooling liquid container (36) and the cooling liquid flowing pipes (35) for connecting from a first liquid cooling channel; the second cooling pipe (32), the second cooling self-priming pump (34), the liquid container (36) and the cooling liquid flowing pipes (35) for connecting from a second liquid cooling channel; and the circuit assembly (4) comprises a start switch (41), an ignition switch (42), a main control board (43), an ignition needle (44), a temperature sensor (45), a first liquid level sensor (46), a second liquid level sensor (47) and a third liquid level sensor (48); the start switch (41) and the ignition switch (42) are fixedly arranged on the faceplate (14); the main control board (43) is fixedly arranged in the shell (11); the ignition needle (44) is fixedly arranged on the combustion groove (13) and is located by the side of the alcohol discharge head (26); and the temperature sensor (45), the first liquid level sensor (46), the second liquid level sensor (47) and the third liquid level sensor (48) are fixedly arranged on the combustion groove (13); and the start switch (41), the ignition switch (42), the ignition needle (44), the temperature sensor (45), the first liquid level sensor (46), the second liquid level sensor (47), the third liquid level sensor (48), the alcohol self-priming pump (24), the submersible pump (25), the first cooling self-priming pump (33) and the second cooling self-priming pump (34) are electrically connected with the main control board (43).

2. The liquid-cooled intelligent alcohol fireplace according to claim 1, characterized in that the circuit assembly (4) further comprises a loudspeaker electrically connected with the main control board (43).

3. The liquid-cooled intelligent alcohol fireplace according to claim 1, characterized in that a thermal insulator (15) is arranged between the faceplate (14) of the fireplace body (1) and the combustion groove (13).

4. The liquid-cooled intelligent alcohol fireplace according to claim 3, characterized in that the thermal insulator (15) is made of bakelite.

5. The liquid-cooled intelligent alcohol fireplace according to claim 1, characterized in that heat dissipation holes (11-1-1) are formed in the shell (11).

6. The liquid-cooled intelligent alcohol fireplace according to claim 1, characterized in that the material of the combustion groove (13) is aluminum alloy.

* * * * *